US009145226B2

(12) United States Patent
Barriere et al.

(10) Patent No.: US 9,145,226 B2
(45) Date of Patent: Sep. 29, 2015

(54) FOLDABLE PACKAGING WITH LOCKING SYSTEM IN FOLDED POSITION

(75) Inventors: Fabienne Barriere, Saint Genest Malifaux (FR); Philippe Wandels, Lyons (FR)

(73) Assignee: bioMèrieux, Marcy l'Etoile (FR)

( * ) Notice: Subject to any disclaimer, the term of this patent is extended or adjusted under 35 U.S.C. 154(b) by 1160 days.

(21) Appl. No.: 13/056,213

(22) PCT Filed: Jul. 16, 2009

(86) PCT No.: PCT/FR2009/051419

§ 371 (c)(1),
(2), (4) Date: Jan. 27, 2011

(87) PCT Pub. No.: WO2010/018333

PCT Pub. Date: Feb. 18, 2010

(65) Prior Publication Data

US 2011/0126496 A1 Jun. 2, 2011

(30) Foreign Application Priority Data

Aug. 11, 2008 (FR) ..... 08 55509

(51) Int. Cl.
*B65D 5/66* (2006.01)
*B65D 5/36* (2006.01)
(Continued)

(52) U.S. Cl.
CPC ..... *B65D 5/3621* (2013.01); *B65D 5/52* (2013.01); *B65D 5/5415* (2013.01)

(58) Field of Classification Search
CPC .... B65D 43/16; B65D 43/161; B65D 43/162; B65D 5/54; B65D 5/5415; B65D 5/545; B65D 5/66; B65D 5/6608; B65D 5/665; B65D 5/30; B65D 5/301; B65D 5/302; B65D 5/308; B65D 5/26; B65D 5/10; B65D 5/103; B65D 5/106; B65D 5/02; B65D 5/0218; B65D 5/0254
USPC ..... 206/766, 45.21; 53/473, 484, 491; 229/103, 117.07, 236, 71, 931
See application file for complete search history.

(56) References Cited

U.S. PATENT DOCUMENTS 316,447 A * 4/1885 Duguay ..... 229/103
1,632,185 A * 6/1927 Jenner ..... 248/459
(Continued)

FOREIGN PATENT DOCUMENTS

DE 11 18 094 11/1961
FR 2 507 156 A1 12/1982
(Continued)

OTHER PUBLICATIONS

International Search Report in International Application No. PCT/FR2009/051419; dated Dec. 22, 2009 (with English-language translation).
(Continued)

*Primary Examiner* — Gloria R Weeks
(74) *Attorney, Agent, or Firm* — Oliff PLC

(57) ABSTRACT

A substantially parallelepiped packaging made of a flexible material such as cardboard, capable of serving as a display stand, including a surface serving as a lid and a surface with at least one cutout, wherein the surface serving as a lid is inserted into the cutout, making it possible to lock the packaging once the same is folded in a planar configuration.

19 Claims, 4 Drawing Sheets

(51) Int. Cl.

| | |
|---|---|
| ***B65D 5/52*** | (2006.01) |
| ***B65D 5/54*** | (2006.01) |

(56) References Cited

U.S. PATENT DOCUMENTS

| | | | | |
|---|---|---|---|---|
| 2,384,559 | A * | 9/1945 | Powell | 229/117 |
| 4,434,890 | A * | 3/1984 | Sieck et al. | 206/443 |
| 4,817,866 | A * | 4/1989 | Wonnacott | 206/427 |
| 5,123,589 | A * | 6/1992 | Cote | 229/232 |
| 5,178,396 | A * | 1/1993 | Lyon et al. | 273/285 |
| 5,483,254 | A * | 1/1996 | Powell | 345/87 |
| 5,695,097 | A * | 12/1997 | Rollinghoff | 222/531 |
| 5,740,959 | A * | 4/1998 | Savage | 229/103.3 |
| 5,845,781 | A * | 12/1998 | Alico et al. | 206/736 |
| 5,996,797 | A * | 12/1999 | Flaig | 206/494 |
| 6,435,351 | B1 * | 8/2002 | Gibb | 206/736 |
| D465,416 | S * | 11/2002 | Dzwill et al. | D9/432 |
| 6,588,586 | B2 * | 7/2003 | Abasolo et al. | 206/204 |
| D484,046 | S * | 12/2003 | Kopecky | D9/432 |
| 6,848,573 | B2 * | 2/2005 | Gould et al. | 206/141 |
| 6,922,976 | B2 * | 8/2005 | Correll | 53/452 |
| 7,533,773 | B2 * | 5/2009 | Aldridge et al. | 206/738 |
| 7,578,393 | B2 * | 8/2009 | Gillon | 206/774 |
| 7,726,547 | B2 * | 6/2010 | Tachikawa et al. | 229/68.1 |
| D644,100 | S * | 8/2011 | Stacy-Ryan | D9/423 |
| 8,066,176 | B2 * | 11/2011 | Nielsen | 229/117.07 |
| 8,235,205 | B2 * | 8/2012 | Mitten et al. | 206/268 |
| 8,393,469 | B2 * | 3/2013 | Aldridge et al. | 206/460 |
| 8,479,477 | B2 * | 7/2013 | Mitten et al. | 53/456 |
| D693,678 | S * | 11/2013 | Kanchan | D9/432 |
| 8,651,309 | B2 * | 2/2014 | Gualersi et al. | 220/4.28 |
| 2003/0080020 | A1 * | 5/2003 | Kopecky | 206/526 |
| 2006/0027483 | A1 * | 2/2006 | Aldridge | 206/738 |
| 2010/0051678 | A1 * | 3/2010 | Anderson et al. | 229/162.1 |
| 2011/0232235 | A1 * | 9/2011 | Aldridge | 53/448 |

FOREIGN PATENT DOCUMENTS

| | | |
|---|---|---|
| FR | 2 771 075 A1 | 5/1999 |
| GB | 2 252 546 A | 8/1992 |

OTHER PUBLICATIONS

Written Opinion of the International Searching Authority in International Application No. PCT/FR2009/051419; dated Dec. 22, 2009 (with English-language translation).

* cited by examiner

FOLDABLE PACKAGING WITH LOCKING SYSTEM IN FOLDED POSITION

The technical field of the present invention is that of packaging. More specifically, the present invention relates to a substantially parallelepipedal-shaped packaging made of flexible material which, after its contents have been used, can be folded and locked in a folded position.

The prior art offers numerous prefolded packagings that are easy to unfold. As an example, the document FR 2 507 156 thus discloses a folded packaging intended, after unfolding and shaping, for the presentation and transportation of food products, in particular intended for the fast food industry. Such packagings are intended to be stored in folded form before use, with minimal bulk, and to be spread out easily. On the other hand, their ability to be folded, for example for their disposal, is not essential.

The document U.S. Pat. No. 2,384,559 discloses a box provided with a separate lid. Through a set of partial cutouts and folds on the bottom of said box, the latter can be folded, unfolded or crushed. Its rigidity is provided by a reinforced bottom. Nevertheless it has a tendency to straighten after folding or crushing.

The document GB 2 252 546 discloses a packaging which can be used both to transport products, and to present them, after opening two precut faces serving as a lid. This dual transportation and presentation function addresses the need to optimize the human involvement in the transportation-storage-presentation chain, and to protect the environment by avoiding having one type of packaging for each function. However, the rigidity of the whole is weakened by the cutouts and by the tongues intended for opening, in particular when such filled containers are stacked. Furthermore, the crushing of the box after use is not an aim for this configuration.

The patent FR 2 771 075 filed by the applicant relates to a packaging which serves as a display stand and which can be packed flat, when empty, by simple pressure. Said packaging is made rigid by its contents. A particular cutout on one of its faces allows easy folding when the products are no longer present. After use, the folding allows for disposal of the duly "crushed" box with minimal waste volume. Here too, the packaging is environmentally friendly by addressing two constraints:

- a single rigid container for the transportation and presentation of the product, and
- a reduced volume of said container before disposal.

One of the problems presented by such packaging is that the cutout intended to facilitate folding weakens the packaging, more particularly when a number of packagings of this type, filled with the products for which they are intended, are stacked.

Another problem encountered with such packaging, and mentioned above for other known packagings, is its tendency to straighten after folding or crushing. This movement goes against the desired aim, namely to save space for disposal.

The present invention therefore seeks to remedy the problems identified with existing packagings.

To this end, the invention relates firstly to a substantially parallelepipedal-shaped packaging made of a flexible material such as cardboard, capable of serving as a display stand, comprising a face which serves as a lid and a face with at least one cutout, said face serving as a lid being inserted into said cutout, in order to lock the packaging, once it is folded into a planar configuration.

The invention also relates to a substantially parallelepipedal-shaped packaging made of a flexible material such as cardboard, capable of serving as a display stand, comprising:

- a first face,
- a second face adjacent to the first face, at least a portion of which serves as a flap, said first face and said flap of the second face serving as a lid,
- a third face with at least one cutout,
- in which said flap is inserted into said cutout, in order to lock the packaging, once it is folded into a planar configuration.

Advantageously, the packaging according to the invention also comprises a cutout facilitating the opening of the lid. It may, for example, be a half-moon-shaped cutout, along one edge of the face serving as a lid when the latter is made of a single piece. Alternatively, the cutout may be positioned on the face serving at least partially as a flap.

According to another embodiment, the packaging also comprises scorings, which facilitate pressing and folding.

Scoring should be understood to mean the result of a compression applied to the material in order to hollow out markings in it and facilitate the folding of the material at the compression points.

The face that serves as a lid and the face including the cutout which is used to lock the flat-packing of the packaging are opposite faces of said packaging.

Preferentially, the packaging according to the invention also includes an opening tab, delimited by two cutouts, facilitating the insertion of the lid into the cutout to lock the packaging in the flat position.

Another object of the invention relates to the use of a packaging according to the invention, to package dishes of Petri dish type.

A final subject of the invention is a template made of flexible material such as cardboard comprising folding and gluing areas for its shaping, capable of forming a packaging according to the invention.

The present invention will be better understood in light of the appended figures which represent a particular embodiment of the present invention, and are in no way limiting.

Figure 1:
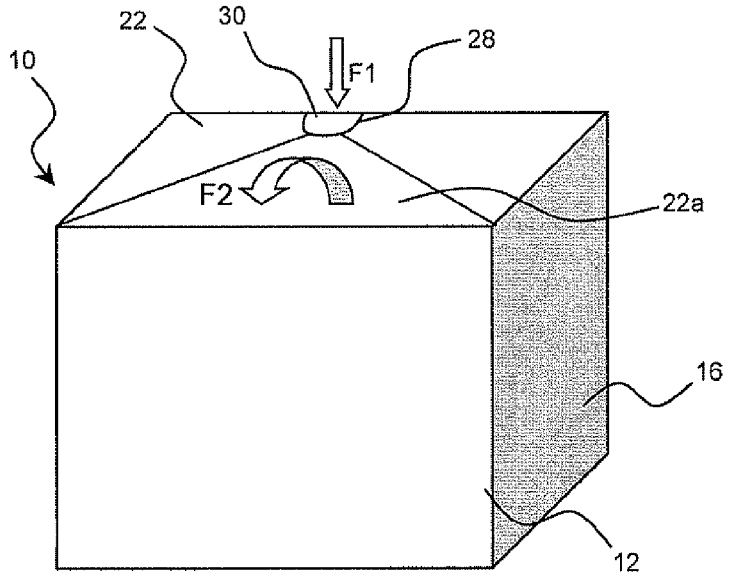
FIG. 1 represents a perspective overview of the packaging according to the invention, closed.
Figure 7:
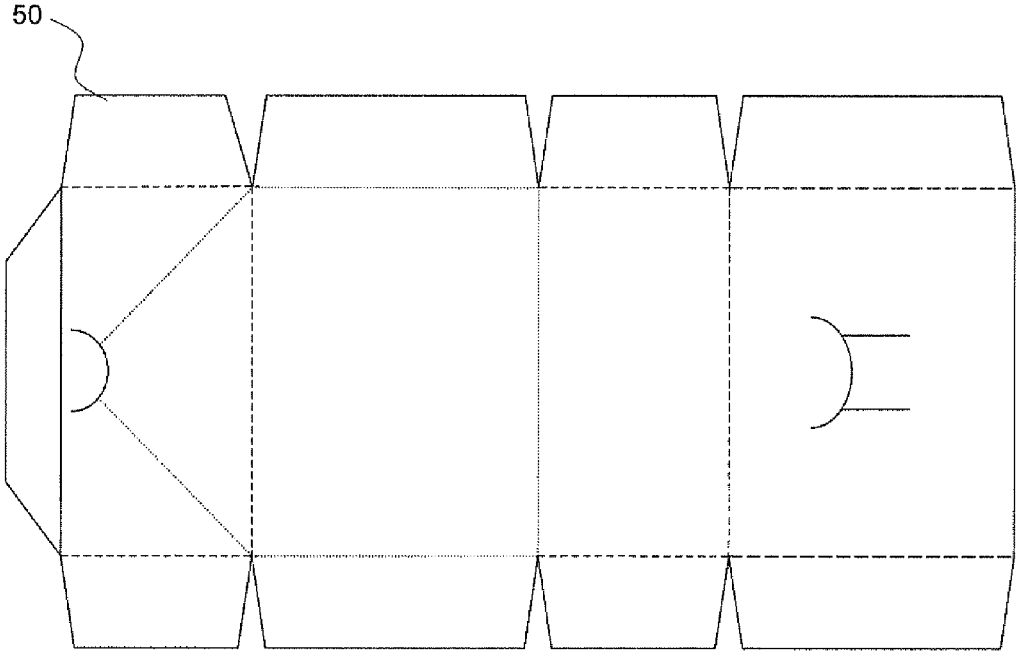
FIG. 7 represents a template or blank of the packaging according to the invention.

The present invention relates to a substantially parallelepipedal-shaped packaging 10 as represented in FIG. 1. This packaging is constructed from a template or blank 50, as represented in FIG. 7, made of flexible material, such as, for example, cardboard.

Folding and gluing areas make it possible to shape the blank 50 and give it a packaging function for products, for example stacked Petri dishes.

The packaging 10 comprises a first face 12 forming the front face in FIG. 1 and a second face 14 (visible in FIG. 2) forming the rear face in FIG. 1, third and fourth faces 16 and 18 (visible in FIG. 2), forming the lateral faces, and faces 20 and 22, respectively forming the bottom and top faces in FIG. 1.

Figure 2:
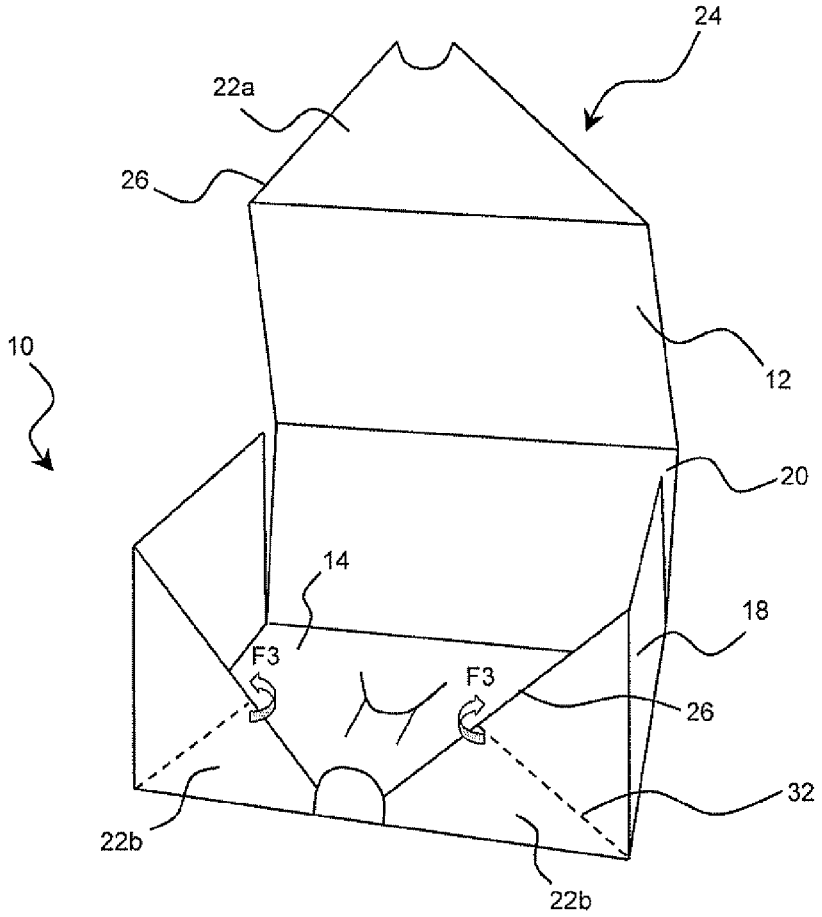
FIG. 2 represents a perspective overview of the packaging open, without its contents.

The packaging 10 according to the present invention includes a lid. According to a preferred embodiment, the lid 24 of the packaging 10 comprises the face 12 and a portion 22*a* of the face 22 is attached to the face 12. This portion serves as a flap and is used to lock the packaging in the flat position, as explained below. This lid 24 is delimited on the face 12 by cutout lines positioned along the lateral edges. Moreover, two cutouts 26 in the face 22, as represented in FIGS. 1 and 2, delimit, after opening of the lid, the portion 22*a*. These cutouts also delimit two triangular areas 22*b*, as indicated in FIGS. 1 and 2. It will be noted that the cutouts delimiting the lid 24, on the face 22 and the edges of the face 12, can be produced in the form of discontinuous precuts, with partial links at regular or irregular intervals.

To facilitate the opening of the lid 24, a half-moon-shaped cutout 28 may be provided on the face 22, as represented in FIG. 1. This cutout 28 provides access to a tongue 30, that can be pressed in according to F1 (FIG. 1), which facilitates access to the lid 24 which is still attached to the rest of the packaging 10, but can thus easily be raised according to F2 (FIG. 1).

Once the lid 24 is opened, the handling of the packaged objects is made easier and said packaging 10 can, if necessary, serve as a display stand.

Once the packaging 10 is emptied of its contents, it is advantageous for the user to dispose of it quickly and in an environmentally friendly way. For this, it is desirable to apply simple movements that require no particular effort, such as manual pressure and folding actions.

Figure 3:
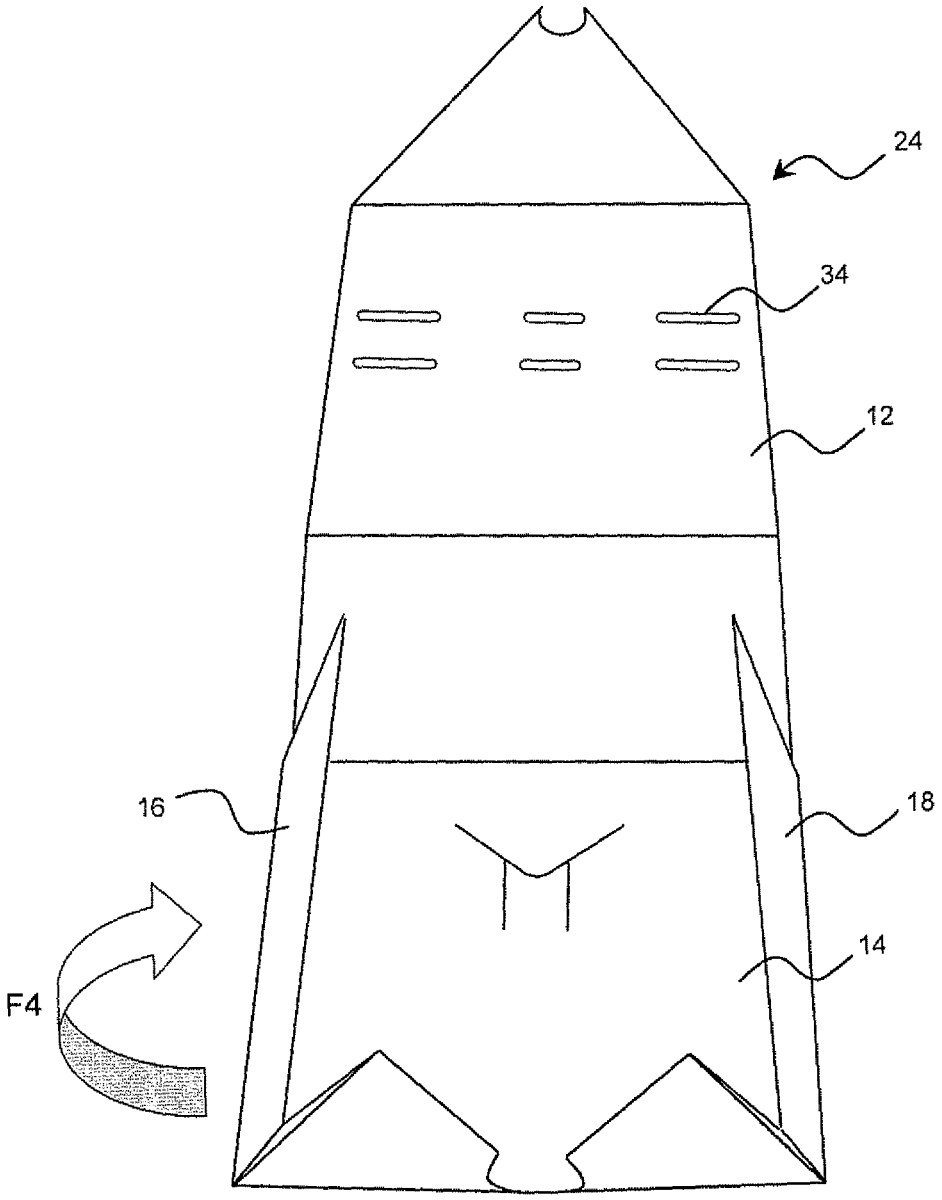
FIG. 3 represents a perspective overview of the packaging in the first folding step.
Figure 4:
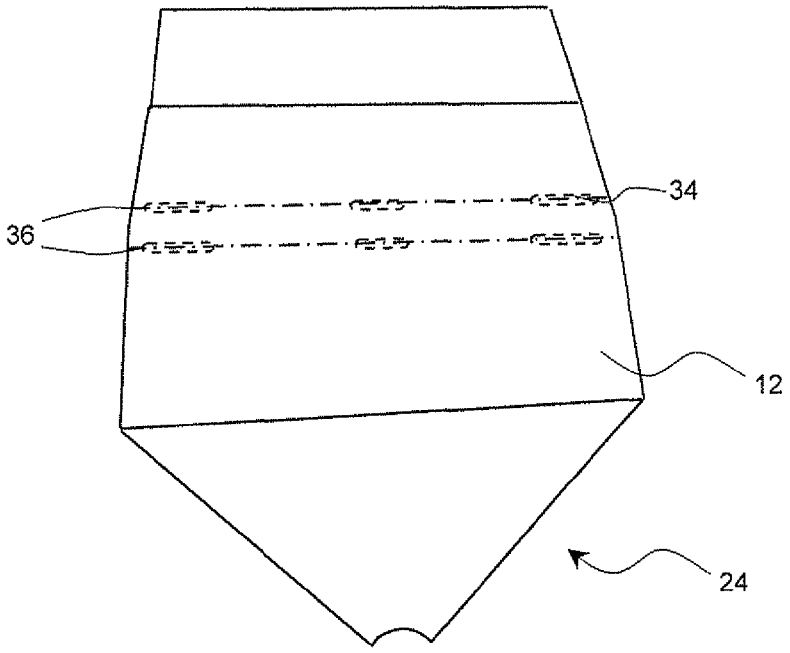
FIG. 4 represents a perspective overview of the packaging flat and turned over, during folding.
Figure 5:
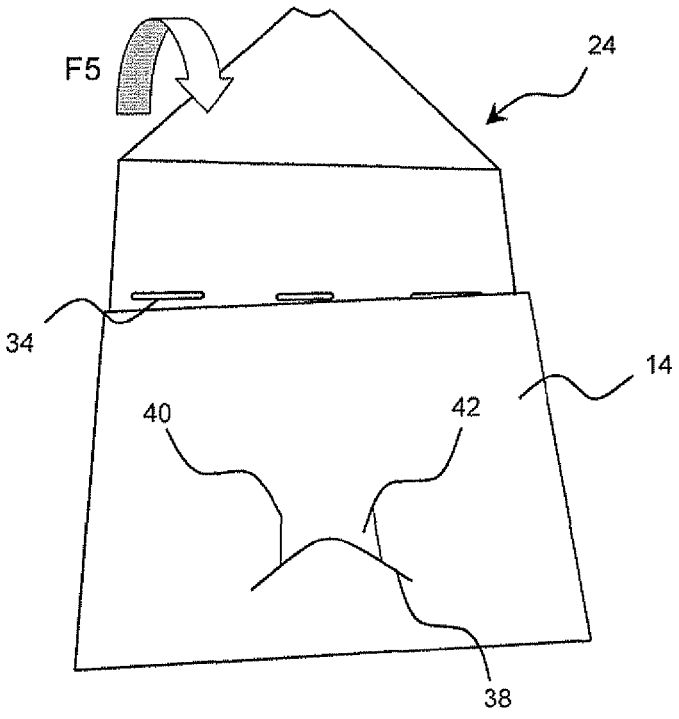
FIG. 5 represents a perspective overview of the packaging during the final folding step.

To this end, the face 20 is dissociated from the lateral faces 16 and 18 by virtue of precuts (not represented) positioned on the edges delimiting the face 20 from the faces 16 and 18. It is then possible to exert pressure on the portions 22*b* of the face 22, according to F3 as indicated in FIG. 2. Advantageously, scorings 32, formed on the inside of said triangular portions 22*b* which remain after the lid 24 has been opened, facilitate the pressing and folding according to F3 (FIG. 2). Pressing on the portions 22*b* and more specifically at the level of the scorings 32 causes said portions 22*b* to be folded into two. This folding then makes it possible to fold back the lateral faces 16 and 18 according to the arrow F4, as represented in FIG. 3. Thus, the faces 16 and 18 and the folded portions 22*b* are in contact with the face 14. The face 20 and the lid 24 can then be folded back over the assembly formed by the faces 14, 16 and 18 and the portions 22*b*, as represented in FIG. 4. Said folding is advantageously facilitated by six transversal scorings 43 provided on the inside of the face 12 of the packaging 10, as illustrated in FIG. 3. They take the form of two groups of three transversally aligned scorings 34. Each group of scorings 34 creates a preferential folding area, embodied by a transversal fold line 36. These fold lines 36, represented by broken lines in FIG. 4, provide for transversal folding of the face 12, according to F5 as represented in FIG. 5, so that the latter is positioned straddling the assembly formed by the faces 14, 16 and 18 and the portions 22*b*. The two fold lines 36 allow the face 12, once it is folded, to adapt perfectly to the bulk formed by the assembly made up of the faces 14, 16 and 18 and the portions 22*b*, folded down.

As represented in FIG. 5, the face 14 includes a cutout 38. This face also includes two additional cutouts 40, positioned longitudinally, adjacent to the cutout 38. These cutouts release a tab 42, which can be pressed in to facilitate access under the tongue 38. The portion 22*a* attached to the face 12 and part of the lid 24 can then be slid under the cutout 38, then locking the packaging in the flat position.

Figure 6:
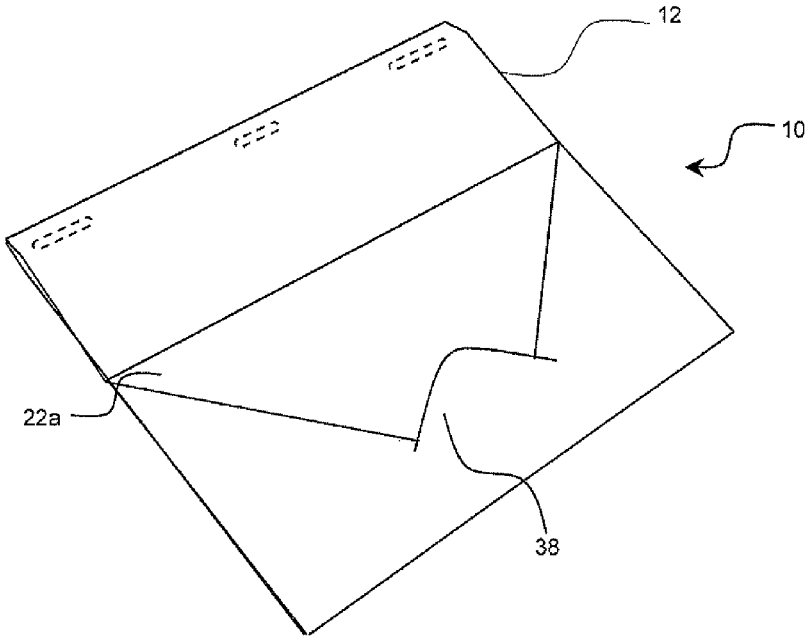
FIG. 6 represents a perspective overview of the packaging folded and locked in the flat position. The packaging then looks like an envelope.

According to an alternative embodiment of the invention, the face 14 of the packaging 10 has only the cutout 38, represented in FIG. 5. On completion of these simple pressing and folding operations, the packaging 10 is folded down and locked in the folded position. This planar configuration, represented in FIG. 6, has a limited thickness which facilitates its storage and minimizes the volume required for its disposal.

It should be noted that, according to a simplified embodiment of the invention, the lid is formed by only a single face, namely the face 12. It is this face 12 which is then slid under the cutout 38. To this end, the cutout 38 may be positioned in an area of the face 14 more suited to the smaller size of the lid 24, in particular on the top portion of the face 14.

The invention claimed is:

1. A packaging made of a flexible material and capable of serving as a display stand, comprising a lid and a face with at least one cutout, wherein the packaging has a substantially parallelepipedal shape in a closed configuration for housing contents in which the lid is non-insertable into the cutout, and the packaging is foldable upon itself into a planar configuration when emptied in which the lid is insertable into the cutout to lock the packaging in the planar configuration.

2. The packaging as claimed in claim 1, further comprising another cutout to facilitate opening of the lid.

3. The packaging as claimed in claim 1, further comprising scorings to facilitate folding by pressure.

4. The packaging as claimed in claim 1, further comprising an opening tab, delimited by two cutouts, to facilitate the insertion of the lid into the cutout to lock the packaging in the planar position.

5. A method of packaging dishes of a Petri dish type, the method comprising packaging the dishes in the packaging as claimed in claim 1.

6. A template made of flexible material comprising folding and gluing areas for shaping the template into the packaging as claimed in claim 1.

7. The template as claimed in claim 6, wherein the flexible material is cardboard.

8. The packaging as claimed in claim 1, wherein the flexible material is cardboard.

9. A packaging made of a flexible material and capable of serving as a display stand, comprising:

a first face, a second face adjacent to the first face, at least a portion of which serves as a flap, said first face and said flap of the second face serving as a lid, and a third face with at least one cutout, wherein the packaging has a substantially parallelepipedal shape in a closed configuration for housing contents in which the flap is non-insertable into the cutout, and the packaging is foldable upon itself into a planar configuration when emptied in which the flap is insertable into the cutout to lock the packaging in the planar configuration.

10. The packaging as claimed in claim 9, wherein the flexible material is cardboard.

11. The packaging as claimed in claim 9, further comprising another cutout to facilitate opening of the lid.

12. The packaging as claimed in claim 9, further comprising scorings to facilitate folding by pressure.

13. The packaging as claimed in claim 9, further comprising an opening tab, delimited by two cutouts, to facilitate the insertion of the flap into the cutout to lock the packaging in the planar position.

14. A method of packaging dishes of a Petri dish type, the method comprising packaging the dishes in the packaging as claimed in claim 9.

15. A template made of flexible material comprising folding and gluing areas for shaping the template into the packaging as claimed in claim 9.

16. A packaging, comprising:

six faces when in a closed configuration to form a substantially parallelepipedal container for packaging contents;

a cutout in one of the faces; and a lid formed on at least one face and openable to access contents of the packaging, the lid and the cutout being unengaged with each other in the closed configuration, wherein the packaging is (i) flexible, (ii) configured to be folded upon itself into a flattened configuration when emptied of contents, and (iii) configured to be locked in the emptied flattened configuration by engaging the lid with the cutout.

17. The packaging as claimed in claim 16, wherein the substantially parallelepipedal container is dimensioned to package a plurality of dishes of a Petri dish type.

18. The packaging as claimed in claim 16, wherein the lid is formed from a first face and a flap of a second face adjacent to the first face, and the cutout is in a third face.

19. The packaging as claimed in claim 18, wherein the first face comprises scorings so that the first face is transversely foldable when folding the packaging into the flattened configuration.

* * * * *